US006953097B2

(12) United States Patent
Seyffert

(10) Patent No.: US 6,953,097 B2
(45) Date of Patent: Oct. 11, 2005

(54) DRILLING SYSTEMS

(75) Inventor: Kenneth W. Seyffert, Houston, TX (US)

(73) Assignee: Varco I/P, Inc., Houston, TX (US)

( * ) Notice: Subject to any disclaimer, the term of this patent is extended or adjusted under 35 U.S.C. 154(b) by 156 days.

(21) Appl. No.: 10/632,702

(22) Filed: Aug. 1, 2003

(65) Prior Publication Data

US 2005/0023038 A1 Feb. 3, 2005

(51) Int. Cl.[7] ..... E21B 20/00
(52) U.S. Cl. ..... 175/66; 175/207
(58) Field of Search ..... 175/65, 66, 207; 209/173, 331

(56) References Cited

U.S. PATENT DOCUMENTS

| | | | | |
|---|---|---|---|---|
| 2,919,898 | A | 1/1960 | Marwil et al. | |
| 3,072,843 | A | 1/1963 | Clements et al. | |
| 3,972,799 | A | 8/1976 | Taylor et al. | 204/300 R |
| 4,063,603 | A * | 12/1977 | Rayborn | 175/65 |
| 4,216,836 | A * | 8/1980 | Rayborn | 175/66 |
| 4,291,772 | A | 9/1981 | Beynet | 175/5 |
| 4,809,791 | A | 3/1989 | Hayatdavoudi | 175/40 |
| 5,570,749 | A | 11/1996 | Reed | 175/66 |
| 5,873,420 | A | 2/1999 | Gearhart | 175/25 |
| 6,065,550 | A | 5/2000 | Gardes | 175/62 |
| 6,138,834 | A | 10/2000 | Southall | 209/17 |
| 6,155,428 | A | 12/2000 | Bailey et al. | 209/315 |
| 6,170,577 | B1 | 1/2001 | Noles, Jr. et al. | 166/312 |
| 6,197,095 | B1 | 3/2001 | Ditria et al. | 95/248 |
| 6,279,471 | B1 | 8/2001 | Reddoch | 100/37 |
| 6,321,860 | B1 | 11/2001 | Reddoch | 175/206 |
| 6,328,107 | B1 | 12/2001 | Maus | 166/335 |
| 6,508,366 | B2 | 1/2003 | Danger et al. | 209/725 |
| 6,517,733 | B1 | 2/2003 | Carlson | 210/785 |
| 6,530,437 | B2 | 3/2003 | Maurer et al. | 175/5 |
| 6,533,946 | B2 | 3/2003 | Pullman | 210/787 |
| 6,536,540 | B2 | 3/2003 | de Boer | 175/70 |
| 6,540,918 | B2 | 4/2003 | Gil et al. | 210/512.1 |
| 6,575,304 | B2 | 6/2003 | Cudahy | 209/365.3 |
| 6,582,600 | B1 | 6/2003 | Hashmi et al. | 210/512.2 |
| 6,585,115 | B1 | 7/2003 | Reddoch et al. | 209/3 |
| 6,588,501 | B1 | 7/2003 | Boyadjieff | 166/75.15 |
| 6,596,169 | B1 | 7/2003 | Rong et al. | 210/512.1 |
| 6,596,170 | B2 | 7/2003 | Tuszko et al. | 210/512.1 |
| 6,599,422 | B2 | 7/2003 | Constantine et al. | 210/512.3 |
| 6,602,181 | B2 | 8/2003 | Quintero et al. | 588/250 |
| 6,607,659 | B2 | 8/2003 | Hensley et al. | 210/87 |
| RE38,367 | E * | 12/2003 | Southall | 209/17 |
| 6,802,379 | B2 | 10/2004 | Dawson et al. | 175/38 |
| 2002/0011338 | A1 | 1/2002 | Maurer et al. | |
| 2003/0070840 | A1 | 4/2003 | Boer | |
| 2003/0136584 | A1 | 7/2003 | Risher et al. | |
| 2003/0136747 | A1 | 7/2003 | Wood et al. | |
| 2004/0154963 | A1 * | 8/2004 | Rayborn | 209/331 |

FOREIGN PATENT DOCUMENTS

| | | | |
|---|---|---|---|
| WO | WO 99/22113 | 10/1998 | E21B/21/06 |
| WO | WO 00/76889 A1 | 6/2000 | |

OTHER PUBLICATIONS

Verti–G Cuttings Dryer: Proactive enviromental protection—productive fluids recovery, Saveguard Swaco, a Smith/Schlumberger Col., 3 pp. 2000.
Vortex Dryer, Brandt, 2001.
Our Experience For Our Customers, Nol–Tec Europe, SRL, 49 pp. 2001.

* cited by examiner

*Primary Examiner*—William Neuder
(74) *Attorney, Agent, or Firm*—Guy McClung

(57) ABSTRACT

Systems and methods for providing a mixture of drilling fluid and beads into a flow of drilling fluid, e.g., flowing in a conduit or flowing upwardly within an annulus of a riser, the method in certain aspects including: introducing an initial stream including a mixture of drilling fluid and beads into a hydrocyclone; processing the initial stream with the hydrocyclone producing a first stream and a second stream, the first stream containing drilling fluid and beads and the second stream containing drilling fluid; and feeding the first stream to shale shaker apparatus and/or to centrifugal liquid/liquid separator apparatus producing a primary stream and a secondary stream, the primary stream including beads and drilling fluid; and feeding the primary stream into the conduit or into an annulus of the riser.

22 Claims, 4 Drawing Sheets

DRILLING SYSTEMS

BACKGROUND OF THE INVENTION

1. Field of the Invention

The present invention, in at least certain embodiments, is directed to methods for efficiently recovering beads or spheres from a dual density drilling fluid; to systems useful in such recovery; and to dual gradient drilling systems and processes that use such bead or sphere recovery methods.

2. Description of Related Art

The prior art discloses a variety of systems for providing drilling fluids (often referred to as "drilling mud") for oil and gas drilling applications and methods and apparatus for varying the density of mud in deep water oil and gas drilling operations. In many such methods drilling mud drives drill bits, maintains hydrostatic pressure, and carries away particulate matter, debris, and drilled cuttings. In many methods drilling mud is pumped down the drill pipe and provides the fluid driving force for a drill bit and then it flows back up from the bit along the periphery of the drill pipe in an annulus between the drill pipe and a tubular or an open hole's interior for removing the particles drilled away by the drill bit. Mud returning to the surface is cleaned to remove the particles, debris, drilled cuttings, etc. and recycled down into the wellbore.

In many prior art methods, density of the drilling mud is monitored and controlled to maximize the efficiency of the drilling operation and to maintain a desired hydrostatic pressure. A well is drilled in many typical operations using a drill bit mounted on the end of a drill stem inserted down the drill pipe. Mud is pumped down the drill pipe and through the drill bit to drive the bit. A gas flow can also pumped and/or other additives are also pumped into the drill pipe to control the density of the mud. Mud passes through the drill bit and flows upwardly along the drill string inside the open hole and casing, carrying the drilled cuttings etc. to the surface. U.S. Pat. No. 5,873,420 discloses an air and mud control system for underbalanced drilling which provides, among other things, for a gas flow in the tubing for mixing the gas with the mud in a desired ratio so that mud density is reduced to permit enhanced drilling rates by maintaining the well in an underbalanced condition.

Formation pressure on earth formations increases as a function of depth due to the weight of the overburden on particular strata. This weight increases with depth so the prevailing or quiescent bottom hole pressure is increased in a generally linear curve with respect to depth. As the well depth is doubled, the pressure is also doubled. When drilling in deep water or ultra deep water this is further complicated because of the pressure on the sea floor by the water above it. High-pressure conditions exist at the beginning of the hole and increase as the well is drilled. A balance must be maintained between the mud density and pressure and the hole pressure or the pressure in the hole will force material back into the well bore and cause what is commonly known as a blowout in which gases in the well bore flow out of the formation into the well bore and bubble upward. When the standing column of drilling fluid is equal to or greater than the pressure at the depth of the borehole the conditions leading to a blowout are minimized. When the mud density is insufficient, the gases or fluids in the borehole can cause the mud to decrease in density and become so light that a blowout occurs which can bring drilling operations to a halt and cause significant damage and injury. Usually blowout preventers or BOP's are installed at the ocean floor to minimize a blowout from an out-of-balance well. One primary method for minimizing blowout is the proper balancing of the drilling mud density to maintain the well in balance at all times. While BOP's can contain a blowout and minimize the damage to personnel and the environment, the well is usually lost once a blowout occurs, even if contained. Proper mud control techniques can reduce the risk of a blowout and obviate the need to contain a blowout once it occurs. In certain methods, to maintain a safe margin, the column of drilling mud in the annular space around the drill stem is of sufficient weight and density to produce a high enough pressure to limit risk to near zero in normal drilling conditions, but this can slow the drilling process. Underbalanced drilling is sued in some prior art methods to increase the drilling rate.

The need to provide a high density mud in a well bore that starts several thousand feet below sea level in deep water or ultra deep water drilling can present a variety of problems. Pressure at the beginning of the hole is equal to the hydrostatic pressure of the seawater above it, but the mud must travel from the sea surface to the sea floor before its density is useful. To maintain mud density at or near seawater density (or 8.6 PPG) when above the borehole and at a heavier density from the seabed down into the well is desirable. Pumps have been employed in certain prior art methods near the seabed for pumping out the returning mud and cuttings from the seabed above the BOP's and to the surface using a return line that is separate from the typical subsea riser system, a system which is expensive to install, requiring separate lines, expensive to maintain and very expensive to run.

In typical offshore drilling, a riser extends from the sea floor to a drill ship and drilling fluid is circulated down the drill stem and up the borehole annulus, the casing set in the borehole, and the riser, back to the drill ship. The drilling fluid performs several functions, including well control. The weight or density of the drilling fluid is selected so as to maintain well bore annulus pressure above formation pore pressure, so that the well does not "kick", and below fracture pressure, so that the fluid does not hydraulically fracture the formation and cause lost circulation. In deep water, the pore pressure and fracture pressure gradients are typically close together. In order to avoid lost circulation or a kick, it is necessary to maintain the drilling fluid pressure between the pore pressure gradient and the fracture pressure gradient.

The drilling fluid hydrostatic pressure gradient in conventional riser drilling is a straight line extending from the surface. This hydrostatic pressure gradient line traverses across the pore pressure gradient and fracture pressure gradient over a short vertical distance, which can result in having to set numerous casing strings. The setting of casing strings is expensive in terms of time and equipment. Various prior art systems—called dual gradient drilling systems—disclose attempts to decouple the hydrostatic head of the drilling fluid in the riser from the effective and useful hydrostatic head in the well bore. In dual gradient systems, the hydrostatic pressure in the annulus at the mud line is equal to the pressure due to the depth of the seawater and the pressure on the borehole is equal to the drilling fluid hydrostatic pressure. The combination of the seawater gradient at the mud line and drilling fluid gradient in the well bore results in greater depth for each casing string and a reduction of the total number of casing strings required to achieve any particular bore hole depth.

Various methods in the prior art have been proposed to produce an efficient and effective dual gradient system. In one method drilling fluid returns are continuously dumped at the sea floor. This is not safe, environmentally practical or economically viable. In another method, gas lift is used involving injecting a gas such as nitrogen into the riser. This requires no major subsea mechanical equipment, but it has some limitations. Since gas is compressible, the depth at which it may be utilized is limited and extensive surface equipment may be required. Also, because the gas expands as the drilling fluid reaches the surface, surface flow rates can be excessive.

Another prior art attempt to create an effective dual gradient system is pumping the drilling fluid from the underwater wellhead back to the surface. Several pumping systems have been suggested, including jet style pumps, positive displacement pumps, and centrifugal pumps. Sea floor pump systems provide the flexibility needed to handle drilling situations, but they have the disadvantage of high cost and reliability problems associated with keeping complex pumping systems operating reliably on the sea floor.

U.S. Pat. No. 6,536,540 issued Mar. 25, 2003 and U.S. Patent Application 20030070840 published Apr. 17, 2003 disclose, among other things, methods and apparatus for controlling drilling mud density at or near the sea bed of wells in deep water and ultra deep-water applications. By combining the appropriate quantities of drilling mud with a base fluid of lesser density, a riser mud density at or near the density of seawater may be achieved. No additional hardware is required below the surface. The riser charging lines are used to inject the low-density base fluid at or near the BOP stack on the seabed. The cuttings are brought to the surface with the diluted mud and separated in the usual manner. The diluted mud is then passed through a centrifuge system to separate the heavier drilling mud from the lighter base fluid.

Another prior art method employs the injection of low-density particles such as glass beads into the returning fluid in the riser above the sea floor to reduce the density of the returning mud as it is brought to the surface. Glass beads are injected above the BOP stack. U.S. Pat. No. 6,530,437 discloses such methods in which a multi-gradient system for drilling a well bore from a surface location into a seabed includes an injector for injecting buoyant substantially incompressible, e.g. glass beads, articles into a column of drilling fluid associated with the well bore. In one such method, the substantially incompressible articles are hollow substantially spherical bodies. All patents and applications referred to herein are incorporated fully herein for all purposes.

SUMMARY OF THE PRESENT INVENTION

The present invention, in certain aspects, discloses wellbore drilling methods and methods for providing a mixture of drilling fluid and beads into a flow of drilling fluid flowing upwardly within a riser, the methods including introducing an initial stream including a mixture of drilling fluid and beads into one or more hydrocyclones; processing the initial stream with the hydrocyclone(s) producing a first stream and a second stream, the first stream containing drilling fluid and beads and the second stream containing drilling fluid; feeding the first stream to shale shaker apparatus and/or to centrifugal liquid/liquid separator apparatus producing a primary stream and a secondary stream, the primary stream including beads and drilling fluid; and introducing the primary stream into the flow of drilling fluid in the riser.

The present invention, in certain aspects, discloses methods for providing a mixture of drilling fluid and beads into a flow of drilling fluid flowing upwardly within a riser, the methods including introducing an initial stream including a mixture of drilling fluid and beads into a hydrocyclone; processing the initial stream with the hydrocyclone producing a first stream and a second stream, the first stream containing drilling fluid and beads and the second stream containing drilling fluid, and feeding the first stream to shale shaker apparatus or to centrifugal liquid/liquid separator apparatus producing a primary stream and a secondary stream, the primary stream including beads and drilling fluid, wherein the second stream is drilling fluid substantially free of beads, wherein the first stream is, by volume, between 10% to 30% beads and 70% to 90% drilling fluid, wherein in the aspect including shale shaker apparatus it includes at least one shale shaker having vibrating apparatus able to produce forces of at least 5.5 G force, wherein the primary stream is, by volume, about 50% beads and about 50% drilling fluid, and feeding the primary stream into a flow of drilling fluid flowing upwardly within a riser to reduce density of said drilling fluid flowing upwardly within the riser.

In certain aspects the present invention discloses a method for moving drilling fluid into and out of a wellbore, the wellbore having therein drilling apparatus, and an annulus for fluid flow between an exterior of the drilling apparatus and an interior surface of the wellbore, the wellbore extending from an earth surface down into the earth, the method including flowing drilling fluid down into the drilling apparatus and out therefrom into the annulus, flowing the drilling fluid upwardly in the annulus back to the earth surface, pumping into the drilling fluid flowing upwardly in the annulus a primary stream containing a mixture of drilling fluid and beads to reduce density of the drilling fluid flowing upwardly in the annulus, and the primary stream produced by feeding a first stream to shale shaker apparatus and/or to centrifugal liquid/liquid separator apparatus and thereby producing the primary stream, in the aspect in which shale shaker apparatus is used the primary stream produces as overflow material off a top of the shale shaker apparatus.

The present invention discloses, in at least certain aspects, a method for providing a mixture of drilling fluid and beads into a flow of drilling fluid flowing upwardly within a riser, the method including continuously introducing an initial stream including a mixture of drilling fluid and beads into hydrocyclone apparatus; processing the initial stream with the hydrocyclone apparatus producing a first stream and a second stream, the first stream containing drilling fluid and beads and the second stream containing drilling fluid; continuously producing the first stream; and continuously feeding the first stream into the riser to continuously reduce density of drilling fluid therein.

The present invention discloses, in certain aspects, a method for providing a mixture of drilling fluid and beads into a flow of drilling fluid flowing upwardly within a riser, the method including introducing an initial stream including a mixture of drilling fluid and beads into a hydrocyclone; processing the initial stream with the hydrocyclone producing a first stream and a second stream, the first stream containing drilling fluid and beads and the second stream containing drilling fluid, and feeding the first stream to centrifugal liquid/liquid separator apparatus producing a primary stream and a secondary stream, the primary stream including beads and drilling fluid.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide:

New, useful, unique, efficient, nonobvious devices, systems and methods for providing a stream of drilling fluid and density-reducing beads to reduce the density of a drilling fluid stream, and drilling methods that use such a density-reducing method;

New, useful, unique, efficient, nonobvious devices, systems, and methods for providing a stream of drilling fluid and density-reducing beads into drilling fluid flowing up in an annulus of a riser;

Such systems and methods in which hydrocyclone apparatus and/or centrifugal liquid/liquid separator apparatus is used to separate beads from drilling fluid; and Such systems and methods wherein such a stream of drilling fluid and beads is provided continuously to reduce density of a stream of drilling fluid;

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1:
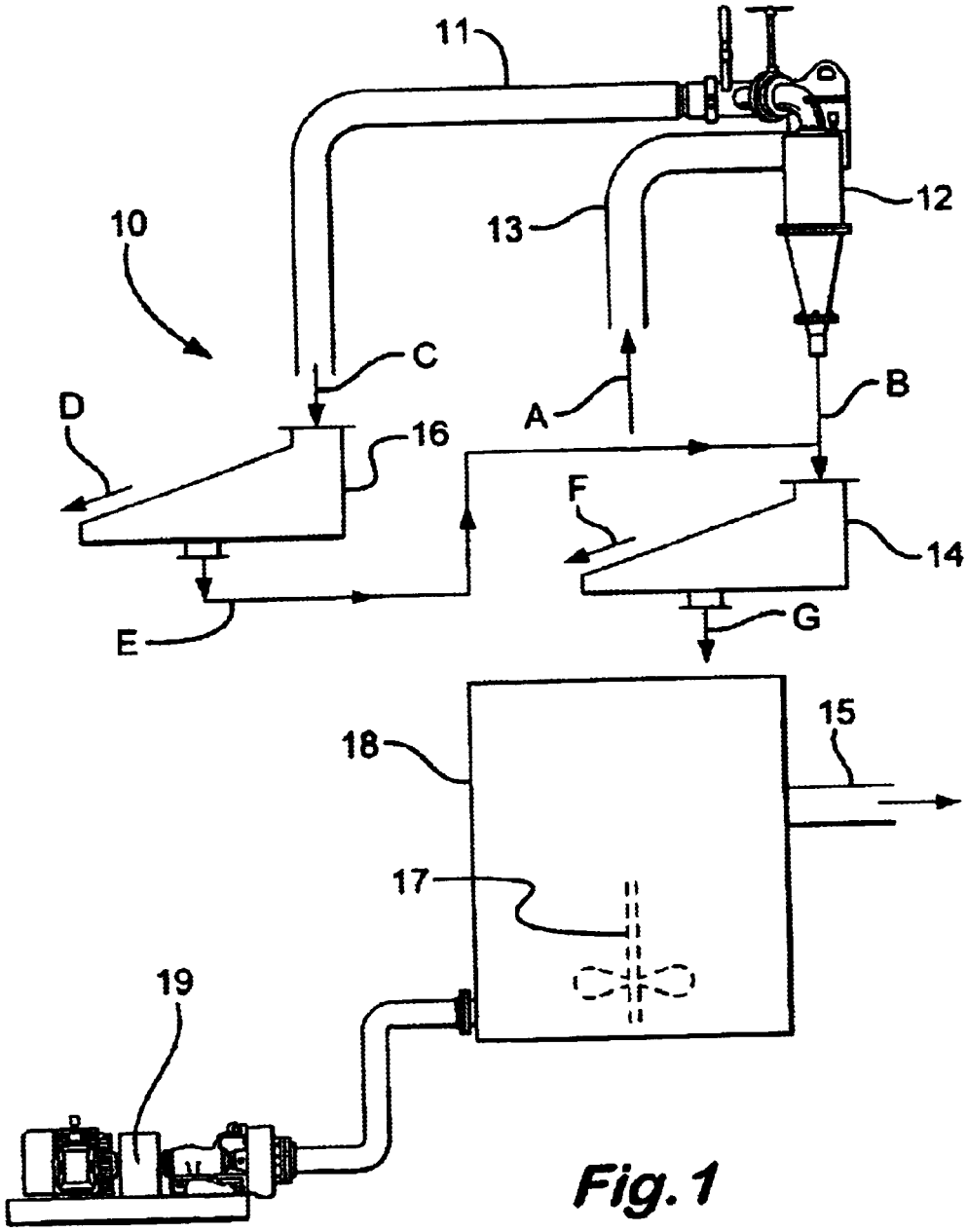
FIGS. 1–4 are schematic views of systems according to the present invention.

Referring now to FIG. 1, a system 10 according to the present invention has a hydrocyclone 12 which, in one particular aspect is a Brandt 12" high pressure cone hydrocyclone from Brandt/Varco Company with a high pressure cone unit. A mixture of drilling fluid and beads is introduced in a line A into the hydrocyclone. The beads may be any known beads used to reduce density of drilling fluid or any suitable bead, hollow or solid, of any desirable shape. e.g., but not limited to spherical, generally cylindrical, or generally cylindrical with rounded ends. In one particular aspect, the mixture in the line A, by volume, is about 50% beads and about 50% drilling fluid. In one particular aspect the beads are hollow glass bodies with a main body that is generally cylindrical in shape, with rounded ends, a length of about 3/16 inch, and a diameter of about 1/8 inch. Within the hydrocyclone 12 the beads are separated and move upwardly within the hydrocyclone 12 and are expelled, with some drilling fluid, into the conduit 11. Drilling fluid substantially free of beads exits from the hydrocyclone 12 and flows, optionally, in a line B to a shale shaker 14. In one aspect the shaker 14 is a typical rig shaker or shakers on a drilling rig. The shale shaker 14 treats the drilling fluid in the line B to produce an exiting overflow F which is primarily separated solids. Exit flow in a line G, which is substantially all drilling fluid, flows to the mud tank 18.

The mixture of beads and drilling fluid expelled by the hydrocyclone 12 flows to a line C which feeds a shale shaker 16. In one aspect the mixture in the conduit 11 is about 20% beads by volume and about 80% drilling fluid. In other aspects these percentages range between 10% to 30% (bead volume) and 70% to 90% (drilling fluid volume). A flow which is drilling fluid and solids from the shaker 16 flows in a line E to the line B and to the shaker 14. In one aspect the mesh on the screen assembly or assemblies in the shaker 16 is between 10 and 20 mesh and there may be some solids in the line E. Drilling fluid from the shaker 14 flows in the line G to the mud tank 18, which, optionally, is agitated by an agitator apparatus 17. Mud (drilling fluid) exits from the mud tank 18 and is pumped therefrom by a pump 19 exiting from the tank in a line 15.

The mixture of beads and fluid in a line D flowing from the top of screen assemblies or of a screen of the shaker 16 can be introduced into the lower part of a wellhead's subsea riser to alter the density of drilling fluid that is rising within the riser. In one particular aspect, the mixture in the line D is, by volume, about 50% beads and about 50% drilling fluid. In one aspect, to achieve such a mixture, a shale shaker capable of providing at least a 5.5 G force and preferably a G force of at least 6.2 G's (with a range between 5 G's to 7 G's for other embodiments, as may be the case for any shaker in any system disclosed herein; and any such shaker may be used with any system or method disclosed herein) is used with a screening deck including screen with a mesh count of at least 10 and, in one particular aspect, a mesh count of 20.

In certain aspects, according to the present invention, the interior of the hydrocyclone is lined with rubber or other soft material to reduce bead breakage.

Figure 2:
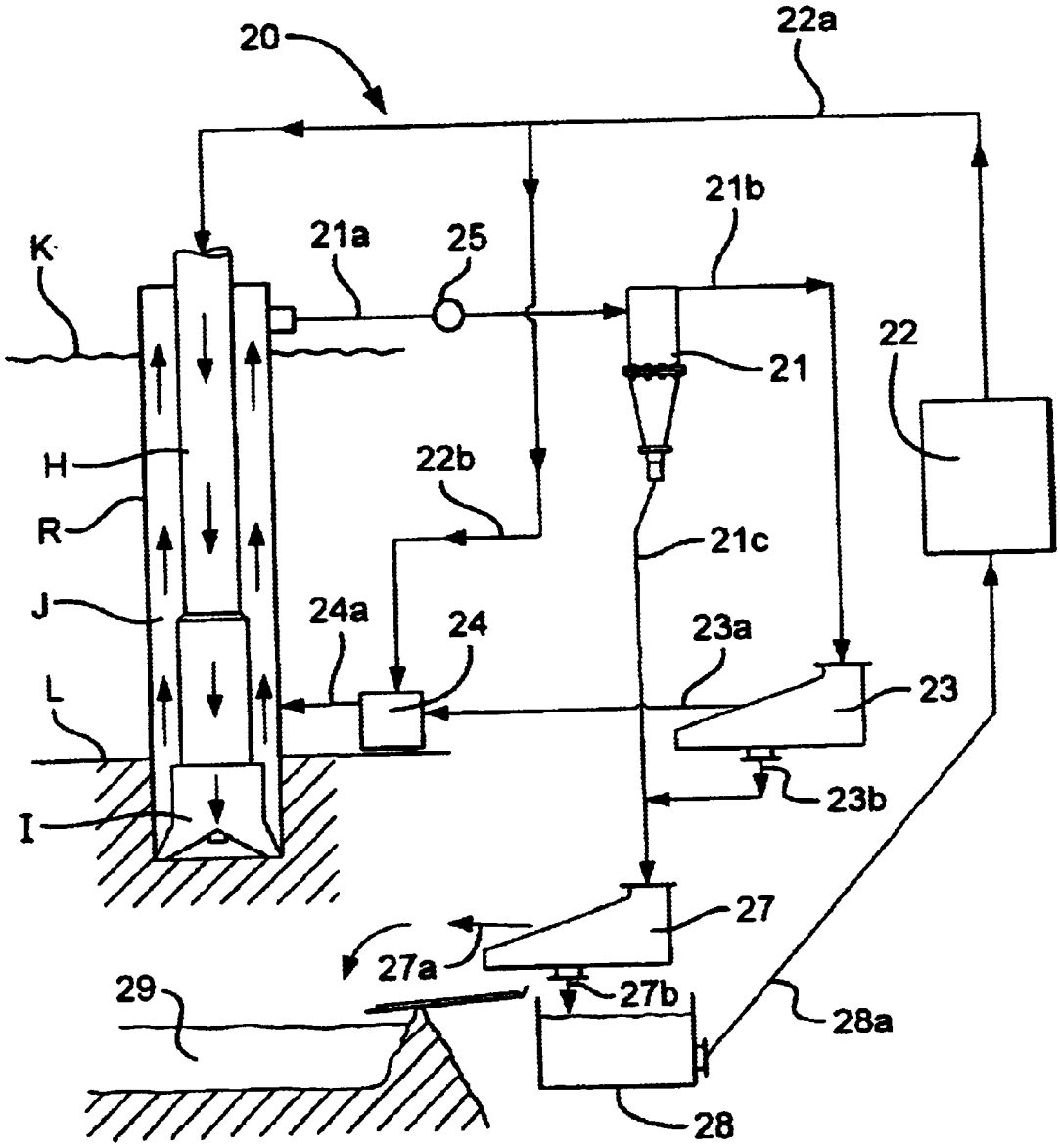

FIG. 2 shows a system 20 according to the present invention in which a hydrocyclone 21 receives a mixture of beads and drilling fluid in a line 21*a* from an annulus J between an interior of a riser R and an exterior of a drill string H which extend from a water surface K down to a bed L.

Optionally, the mixture in the line 21*a* is treated by a separation device 25, e.g. but not limited to a scalper box (e.g. with a 1 to 5 mesh chain or belt) which removes gross pieces of material (e.g. 3/4 inches in largest dimension and up) from the mixture producing an exiting overflow which has beads and drilling fluid therein which flow into the hydrocyclone 21.

A mixture of beads and drilling fluid exits from the top of the hydrocyclone 21 in a line 21*b* and flows to an optional shale shaker 23 which produces an exiting overflow of beads and drilling fluid which flows in a line 23*a* to a fluid supply system 24 and an exiting underflow of drilling fluid and solids in a flow 23*b* (which may, optionally be fed into the line 21*c*.).

The fluid supply system 24 includes appropriate pump(s) and conduit(s) and provides, in one aspect, a mixture which is, by volume, about 50% beads and about 50% drilling fluid which is introduced in a line 24*a* into an annulus around a riser into an upward flow of drilling fluid which has been pumped down a drill string H, through a drill bit I and is ascending upwardly within the annulus around the riser R. As needed, additional drilling fluid may be fed to the fluid supply system 24 from a line 22*a* in a line 22*b*, e.g. to maintain a desired percentage of such fluid by volume in the line 24*a*.

Drilling fluid with solids in it exits from the hydrocyclone 21 and flows in a line 21*c* to a shale shaker 27 which produces an exiting overflow 27*a* which is fed to a mud pit 29; and an exiting underflow which flows in a line 27*b* to a mud tank 28 from which a mud pump system 22 selectively or continuously pumps drilling fluid in lines 28*a* and 22*a* back down the drill string H.

Figure 3:
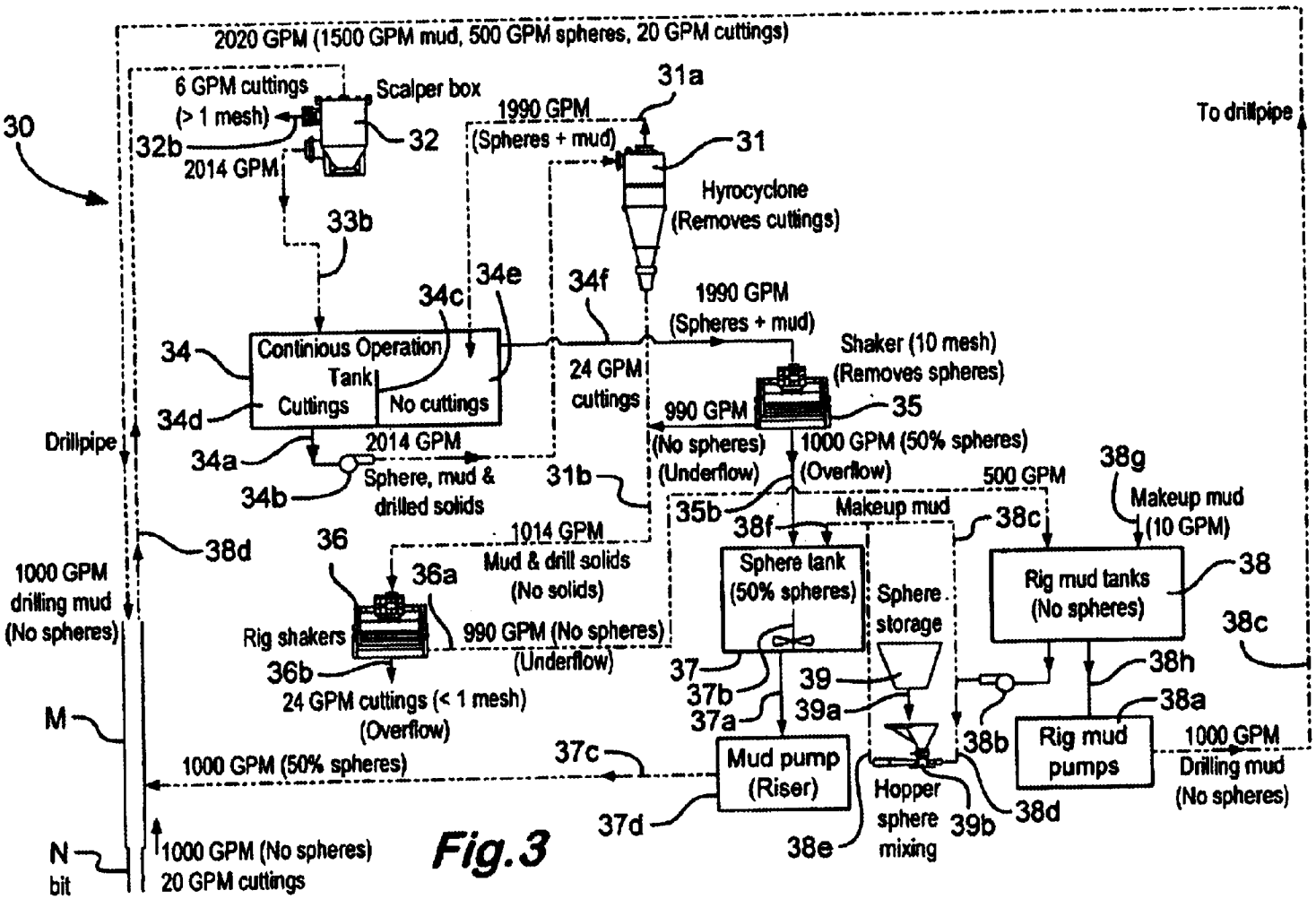

FIG. 3 illustrates a system 30 according to the present invention which has a hydrocyclone 31 which receives a mixture of beads, drilling fluid and drilled cuttings pumped by a pump 34*b* from a tank system 34.

In a line 33*b* the tank system 34 receives a mixture of beads, drilling fluid, drilled cuttings from a wellbore. Material flowing upwardly from a riser M (like the riser R, FIG. 2 and with its associated structures and equipment) flows in a line 38*d* to the system 32, e.g. a scalper box which produces a flow of drilling fluid and beads, etc. for the line 33*b* and a flow primarily of gross-sized cuttings in a line 32*b*.

The hydrocyclone 31 produces a top exit stream containing beads and drilling fluid which flows in a line 31*a* to a compartment 34*e* of the tank system 34. In one particular aspect the tank system 34 has a center weir 34*c* which divides the tank system 34 into a compartment in which drill cuttings are present and a compartment 34*e* in which substantially no such cuttings are present. In one aspect the pump 34*b* pumps material in the line 34*a* at a higher rate than material is introduced into the tank 34 from the line 38*d*; and, in one aspect, sufficient material is fed in the line 31*a* to maintain the tank 34 substantially full. A continuous supply of material can be provided to the line 34*a* and pumped by the pump 34*b* to the hydrocyclone 31, with appropriate and required flow, as and when needed, from the tanks 37 and/or 38; thereby providing a continuous flow to the line 37*c*. Such an ability to provide continuous operation is important in many drilling operations so that drilling can proceed without interruption.

A mixture of beads and drilling fluid (e.g. in one aspect, by volume about 20% beads and about 80% drilling fluid) flows in a line 34*f* to a shale shaker 35 which has screen(s) with a mesh (e.g. between 10 and 20 mesh) that permits the beads to pass through and flow in an exiting underflow with drilling fluid in a line 35*b* to a collection tank 37 which, optionally, has an agitator 37*b* to inhibit bead coalescence and/or to maintain beads within the fluid rather than rising to the top thereof. In one aspect the mixture in the tank 37 is, by volume, about 50% beads and about 50% drilling fluid; and, in one aspect, the combined flows in the lines 38*c* and 38*e* result in a mixture in the tank 37 that is about 50% beads and about 50% drilling fluid. Another feed, which is optional, to the tank 37 is primarily drilling fluid which is provided from a rig drilling fluid system's tank(s) 38 in a line 38*f* to, in one aspect, maintain the percentage of drilling fluid at a desired percentage by volume, e.g., 5% by volume. This fluid exits the tank 38 and is pumped by a pump 38*b* to lines 38*c* and 38*d*. Drilling fluid in the line 38*c* flows into the line 38*f*. Drilling fluid in the line 38*d* flows to a mixer 39*b* which mixes the drilling fluid with beads supplied from a bead storage system 39 via a line 39*a*. A mixture of beads and drilling fluid flows in a line 38*e* to the line 38*f*. The hydrocylcone 31 can remove drilled cuttings from the material input into it in the line 34*a* and expel them in the line 31*b*. In one aspect, the fluid in the line 31*a* contains, by volume, about 50% beads.

From the tank 37 a mixture of beads and drilling fluid is pumped from a line 37*a* by a pump 37*d* to a line 37*c* into the interior of the wellbore in which the riser M is located to join drilling fluid (with drilled cuttings, etc. therein) rising within the wellbore around the riser M.

Makeup drilling fluid, as desired, is pumped in a line 38*g* into the tank 38. A pump system 38*a* receives drilling fluid via a line 38*h* from the tank 38 and pumps it in a line 38*c* down in drill pipe of a drill string (not shown) to a drill bit N.

The various numerical and word legends in FIG. 3 describe one specific embodiment of a system 30. "GPM" refers to a flow in gallons per minute. "Spheres" refers to hollow glass beads as described above. "Underflow" refers to an exit stream from beneath an apparatus. "Overflow" refers to an exit stream from the top of screen(s) of an apparatus. "Drilling mud' refers to drilling fluid. "Mud pump" refers to a pump for pumping drilling fluid. "Mesh" refers to a size of opening in a separation device, e.g. "4 mesh" is a 4 mesh screen. "Cuttings" refers to drilled cuttings. "Rig. shaker" refers to a shale shaker. "Drilled solids" refers to drilled cuttings and/or debris. A numerical legend by a "GPM" indicates a number of gallons per minute of fluid/mixture flow in a line bearing the legend; e.g., "1990 GPM" by line 31*a* indicates, for this particular embodiment, a flow of 1990 gallons per minute in the line 31*a*.

Figure 5:
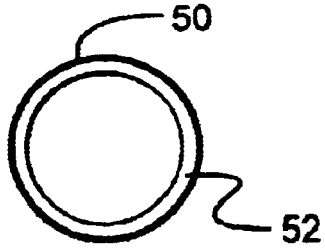
FIG. 5 is a cross-sectional view of a member with a soft lining according to the present invention.

FIG. 5 shows a hollow member 50 through which fluid with density-reducing beads may flow with a lining 52 of rubber or other suitable soft material for reducing damage of the beads and/or for reducing breakage of the beads. It is within the scope of the present invention to line any component of systems according to the present invention with rubber or other suitable soft material that inhibits damage to or breakage of the beads. In one particular aspect, a shale shaker used in systems according to the present invention has basket sides and/or rails, and/or screen assembly top surfaces that are coated with rubber or other suitable soft material to inhibit damage to the beads.

Figure 4:
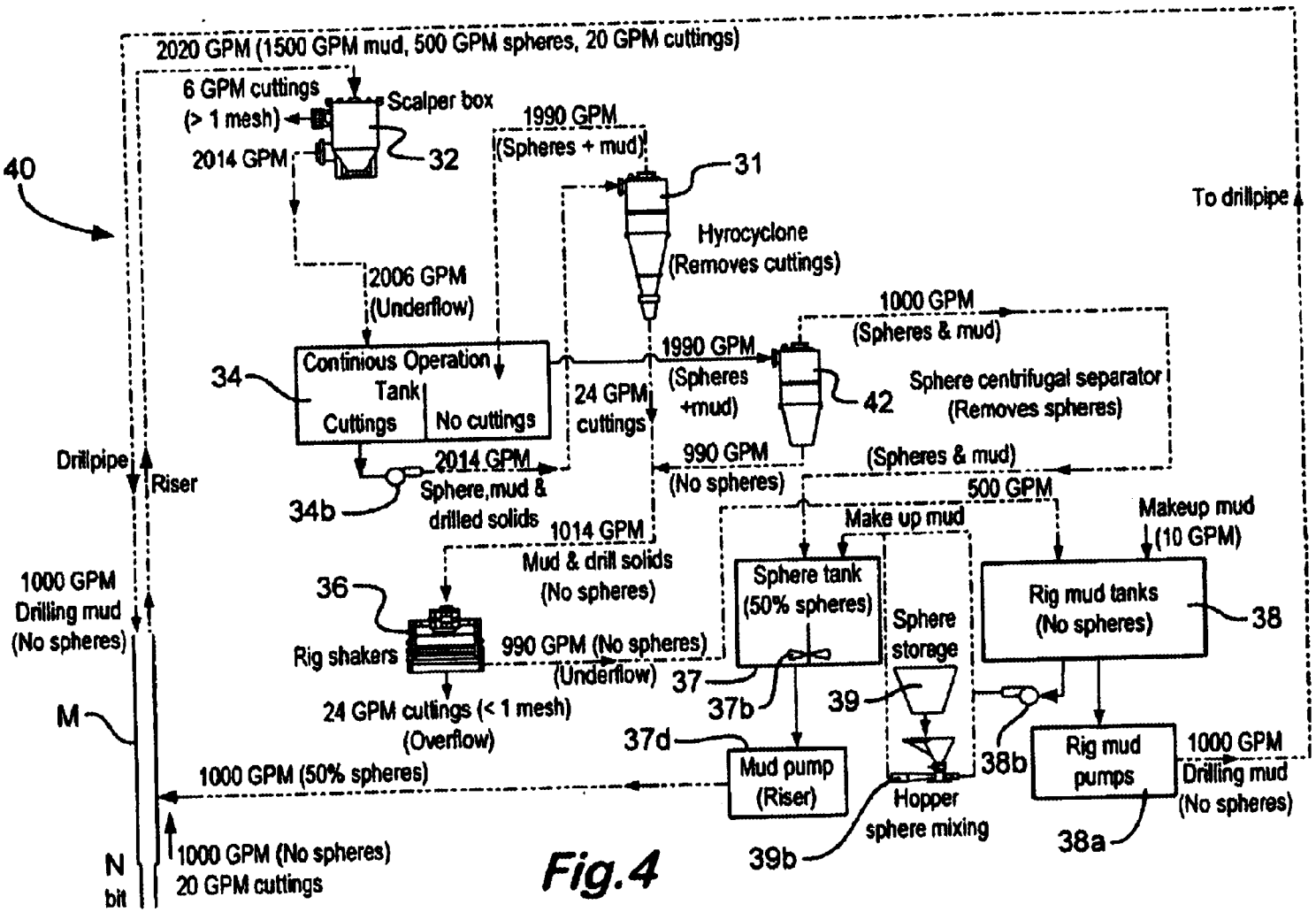

FIG. 4 shows a system 40 according to the present invention which is similar to the system 30 and like numerals indicate like items. The shaker 35 of the system 30 is eliminated from the system 40 and in its place is a separator 42 which separates drilling fluid from beads. In one particular aspect the separator 42 is a centrifugal separator in which a lower density phase exits from the top (e.g. beads and drilling fluid) and a higher density phase (e.g. drilling fluid and solids) exits from the bottom. The system 32 is optional for the system of FIG. 4.

The present invention, therefore, in at least certain aspects, provides a method for providing a mixture of drilling fluid and beads into a flow of drilling fluid flowing upwardly within a riser, the method including introducing an initial stream including a mixture of drilling fluid and beads into a hydrocyclone, processing the initial stream with the hydrocyclone producing a first stream and a second stream, the first stream containing drilling fluid and beads and the second stream containing drilling fluid, and feeding the first stream to shale shaker apparatus producing a primary stream and a secondary stream, the primary stream including beads and drilling fluid. Such a method may include one or some, in any possible combination, of the following: wherein the initial stream is about 50% beads by volume and about 50% drilling fluid by volume; wherein the beads are hollow glass beads; wherein the second stream is drilling fluid substantially free of beads; wherein the first stream is, by volume, between 10% to 30% beads and 70% to 90% drilling fluid; wherein the first stream is, by volume, about 20% beads and about 80% drilling fluid; wherein the shale shaker apparatus includes at least one shale shaker having vibrating apparatus able to produce forces of at least 5.5 G force; wherein the shale shaker apparatus includes at least one shale shaker having vibrating apparatus able to produce forces of at least 6.2 G force; wherein the primary stream is, by volume, about 50% beads and about 50% drilling fluid; wherein the hydrocyclone has an interior lined with soft material to reduce bead breakage; feeding the primary stream into a flow of drilling fluid flowing upwardly within a riser to reduce density of said drilling fluid flowing upwardly within the riser; and/or wherein conduit(s) and/or member(s) through which fluid with beads therein flows is/are lined with soft material to reduce or inhibit damage or breakage of the beads.

The present invention, therefore, in at least certain aspects, provides a method for moving drilling fluid into and out of a wellbore, the wellbore having therein drilling apparatus, and an annulus for fluid flow between an exterior of the drilling apparatus and an interior surface of the wellbore, the wellbore extending from an earth surface down into the earth, the method including flowing drilling fluid down into the drilling apparatus and out therefrom into the annulus, flowing the drilling fluid upwardly in the annulus back to the earth surface, pumping into the drilling fluid flowing upwardly in the annulus a primary stream containing a mixture of drilling fluid and beads to reduce density of the drilling fluid flowing upwardly in the annulus, and the primary stream produced by feeding a first stream to shale shaker apparatus and thereby producing the primary stream as overflow material off a top of the shale shaker apparatus. Such a method may have one or some, in any possible combination, of the following: producing the primary stream by flowing an output stream from hydrocyclone apparatus to the shale shaker apparatus, and the output stream including drilling fluid and beads; and/or wherein the beads are hollow glass beads; wherein the initial stream is about 50% beads by volume and about 50% drilling fluid by volume.

The present invention, therefore, in at least certain aspects, provides a method for providing a mixture of drilling fluid and beads into a flow of drilling fluid flowing in a conduit or flowing upwardly within a riser, the method including continuously introducing an initial stream including a mixture of drilling fluid and beads into a hydrocyclone, processing the initial stream with the hydrocyclone producing a first stream and a second stream, the first stream containing drilling fluid and beads and the second stream containing drilling fluid, continuously producing the first stream and continuously feeding the first stream into the conduit or riser to continuously reduce density of drilling fluid therein.

The present invention, therefore, provides in at least certain embodiments, a drilling method including drilling with drilling apparatus a wellbore down into earth from an earth surface downwardly, flowing (e.g., pumping) drilling fluid down into the drilling apparatus while drilling, flowing (e.g., pumping) drilling fluid and other material upwardly within the wellbore (e.g., within an annulus in the wellbore) away from the drilling apparatus (e.g., with drilled solids, and/or debirs therein), providing a mixture and flowing it into the drilling fluid, the mixture comprising drilling fluid and density-reducing beads, the mixture produced by introducing an initial stream including drilling fluid and beads into a hydrocyclone, processing the initial stream with the hydrocyclone producing a first stream and a second stream, the first stream containing drilling fluid and beads and the second stream containing drilling fluid, and feeding the first stream to separation apparatus producing a primary stream including beads and drilling fluid, and flowing the primary stream into the drilling fluid, e.g. within the annulus and/or within a conduit of the apparatus used for providing the drillling fluid and/or for pumping it. In such a method, the separation apparatus can be shale shaker apparatus and/or centrifugal liquid/liquid separation apparatus.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. A method for providing a mixture of drilling fluid and beads into a flow of drilling fluid flowing upwardly within a riser, the method comprising introducing an initial stream including a mixture of drilling fluid and beads into a hydrocyclone, processing the initial stream with the hydrocyclone producing a first stream and a second stream, the first stream containing drilling fluid and beads and the second stream containing drilling fluid, and feeding the first stream to shale shaker apparatus producing a primary stream and a secondary stream, the primary stream including beads and drilling fluid.

2. The method of claim 1 wherein the initial stream is about 50% beads by volume and about 50% drilling fluid by volume.

3. The method of claim 1 wherein the beads are hollow glass beads.

4. The method of claim 1 wherein the second stream is drilling fluid substantially free of beads.

5. The method of claim 1 wherein the first stream is, by volume, between 10% to 30% beads and 70% to 90% drilling fluid.

6. The method of claim 1 wherein the first stream is, by volume, about 20% beads and about 80% drilling fluid.

7. The method of claim 1 wherein the shale shaker apparatus includes at least one shale shaker having vibrating apparatus able to produce forces of at least 5.5 G force.

8. The method of claim 1 wherein the shale shaker apparatus includes at least one shale shaker having vibrating apparatus able to produce forces of at least 6.2 G force.

9. The method of claim 1 wherein the primary stream is, by volume, about 50% beads and about 50% drilling fluid.

10. The method of claim 1 wherein the hydrocyclone has an interior lined with soft material to reduce bead breakage.

11. The method of claim 1 further comprising feeding the primary stream into a flow of drilling fluid flowing upwardly within a riser to reduce density of said drilling fluid flowing upwardly within the riser.

12. A method for providing a mixture of drilling fluid and beads into a flow of drilling fluid flowing upwardly within a riser, the method comprising introducing an initial stream including a mixture of drilling fluid and beads into a hydrocyclone, processing the initial stream with the hydrocyclone producing a first stream and a second stream, the first stream containing drilling fluid and beads and the second stream containing drilling fluid, and feeding the first stream to shale shaker apparatus producing a primary stream and a secondary stream, the primary stream including beads and drilling fluid, wherein the second stream is drilling fluid substantially free of beads, wherein the first stream is, by volume, between 10% to 30% beads and 70% to 90% drilling fluid, wherein the shale shaker apparatus includes at least one shale shaker having vibrating apparatus able to produce forces of at least 5.5 G force, wherein the primary stream is, by volume, about 50% beads and about 50% drilling fluid, and feeding the primary stream into a flow of drilling fluid flowing upwardly within a riser to reduce density of said drilling fluid flowing upwardly within the riser.

13. A method for providing a mixture of drilling fluid and beads into a flow of drilling fluid flowing upwardly within a riser, the method comprising introducing an initial stream including a mixture of drilling fluid and beads into a hydrocyclone, processing the initial stream with the hydrocyclone producing a first stream and a second stream, the first stream containing drilling fluid and beads and the second stream containing drilling fluid, and a feeding the first stream to centrifugal liquid/liquid separator apparatus producing a primary stream and a secondary stream, the primary stream including beads and drilling fluid.

14. The method of claim 13 wherein the beads are hollow glass beads.

15. The method of claim 13 wherein the secondary stream is drilling fluid substantially free of beads.

16. A method for providing a mixture of drilling fluid and beads into a flow of drilling fluid, the method comprising introducing an initial stream including a mixture of drilling fluid and beads into a hydrocyclone, processing the initial stream with the hydrocyclone producing a first stream and a second stream, the first stream containing drilling fluid and beads and the second stream containing drilling fluid, and feeding the first stream to separation apparatus producing a primary stream and a secondary stream, the primary stream including beads and drilling fluid.

17. A drilling method comprising drilling with drilling apparatus a wellbore down into earth from an earth surface downwardly, flowing drilling fluid down into the drilling apparatus while drilling, flowing drilling fluid and other material upwardly within the wellbore away from the drilling apparatus, providing a mixture and flowing it into the drilling fluid, the mixture comprising drilling fluid and density-reducing beads, the mixture produced by introducing an initial stream including drilling fluid and beads into a hydrocyclone, processing the initial stream with the hydrocyclone producing a first stream and a second stream, the first stream containing drilling fluid and beads and the second stream containing drilling fluid, and feeding the first stream to separation apparatus producing a primary stream including beads and drilling fluid, and flowing the primary stream into the wellbore.

18. The method of claim 17 wherein the separation apparatus is from the group consisting of shale shaker apparatus and centrifugal liquid/liquid separation apparatus.

19. A method for moving drilling fluid into and out of a wellbore, the wellbore having therein drilling apparatus, and an annulus for fluid flow between an exterior of the drilling apparatus and an interior surface of the wellbore, the wellbore extending from an earth surface down into the earth, the method comprising flowing drilling fluid down into the drilling apparatus and out therefrom into the annulus, flowing the drilling fluid upwardly in the annulus back to the earth surface, pumping into the drilling fluid flowing upwardly in the annulus a primary stream containing a mixture of drilling fluid and beads to reduce density of the drilling fluid flowing upwardly in the annulus, the primary stream is produced by feeding a first stream to shale shaker apparatus and thereby producing the primary stream as overflow material off a top of the shale shaker apparatus, producing the primary stream by flowing an output stream from hydrocyclone apparatus to the shale shaker apparatus, and the output stream including drilling fluid and beads.

20. The method of claim 19 wherein the beads are hollow glass beads.

21. The method of claim 19 wherein the initial stream is about 50% beads by volume and about 50% drilling fluid by volume.

22. A method for providing a mixture of drilling fluid and beads into a flow of drilling fluid flowing upwardly within a riser, the method comprising continuously introducing an initial stream including a mixture of drilling fluid and beads into a hydrocyclone, processing the initial stream with the hydrocyclone producing a first stream and a second stream, the first stream containing drilling fluid and beads and the second stream containing drilling fluid, continuously producing the first stream, continuously feeding the first stream into the riser to continuously reduce density of drilling fluid therein, continuously feeding the first stream to shale shaker apparatus producing a primary stream of drilling fluid and beads, and feeding the primary stream into the annulus.

* * * * *